US006597333B2

(12) United States Patent
Todoroki et al.

(10) Patent No.: US 6,597,333 B2
(45) **Date of Patent: *Jul. 22, 2003**

(54) METHOD OF AND SYSTEM FOR CONTROLLING BRIGHTNESS OF PLASMA DISPLAY PANEL

(75) Inventors: Ryuichi Todoroki, Shizuoka-ken (JP); Naruhiro Sato, Shizuoka-ken (JP); Nozomu Kikuchi, Shizuoka-ken (JP); Kenichiro Hosoi, Shizuoka-ken (JP)

(73) Assignee: Pioneer Electronic Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/329,308

(22) Filed: Jun. 10, 1999

(65) Prior Publication Data

US 2002/0167469 A1 Nov. 14, 2002

(30) Foreign Application Priority Data

Jun. 19, 1998 (JP) ..... 10-173469

(51) Int. Cl.[7] ..... G09G 3/28

(52) U.S. Cl. ..... 345/63; 345/589; 345/690; 348/687

(58) Field of Search ..... 345/60, 89, 82, 345/63, 690, 589; 348/687, 688, 689, 700, 673

(56) References Cited

U.S. PATENT DOCUMENTS 5,247,288 A * 9/1993 Warren et al. ..... 345/60
5,451,979 A * 9/1995 Levac ..... 345/82
5,757,343 A * 5/1998 Nagakubo ..... 345/63
5,874,932 A * 2/1999 Nagaoka et al. ..... 345/60

FOREIGN PATENT DOCUMENTS

EP 0841652 A1 5/1998

* cited by examiner

*Primary Examiner*—Dennis-Doon Chow
(74) *Attorney, Agent, or Firm*—Arent Fox Kintner Plotkin & Kahn

(57) ABSTRACT

A method of and a system for controlling a brightness of a picture displayed on a plasma display panel are provided which are capable of determining whether a video signal to be fed to the plasma display panel is a signal indicating a stationary picture, reducing the brightness of a picture displayed on the plasma display panel if it is determined that a video signal to be fed to the plasma display panel is a signal indicating a stationary picture.

11 Claims, 15 Drawing Sheets

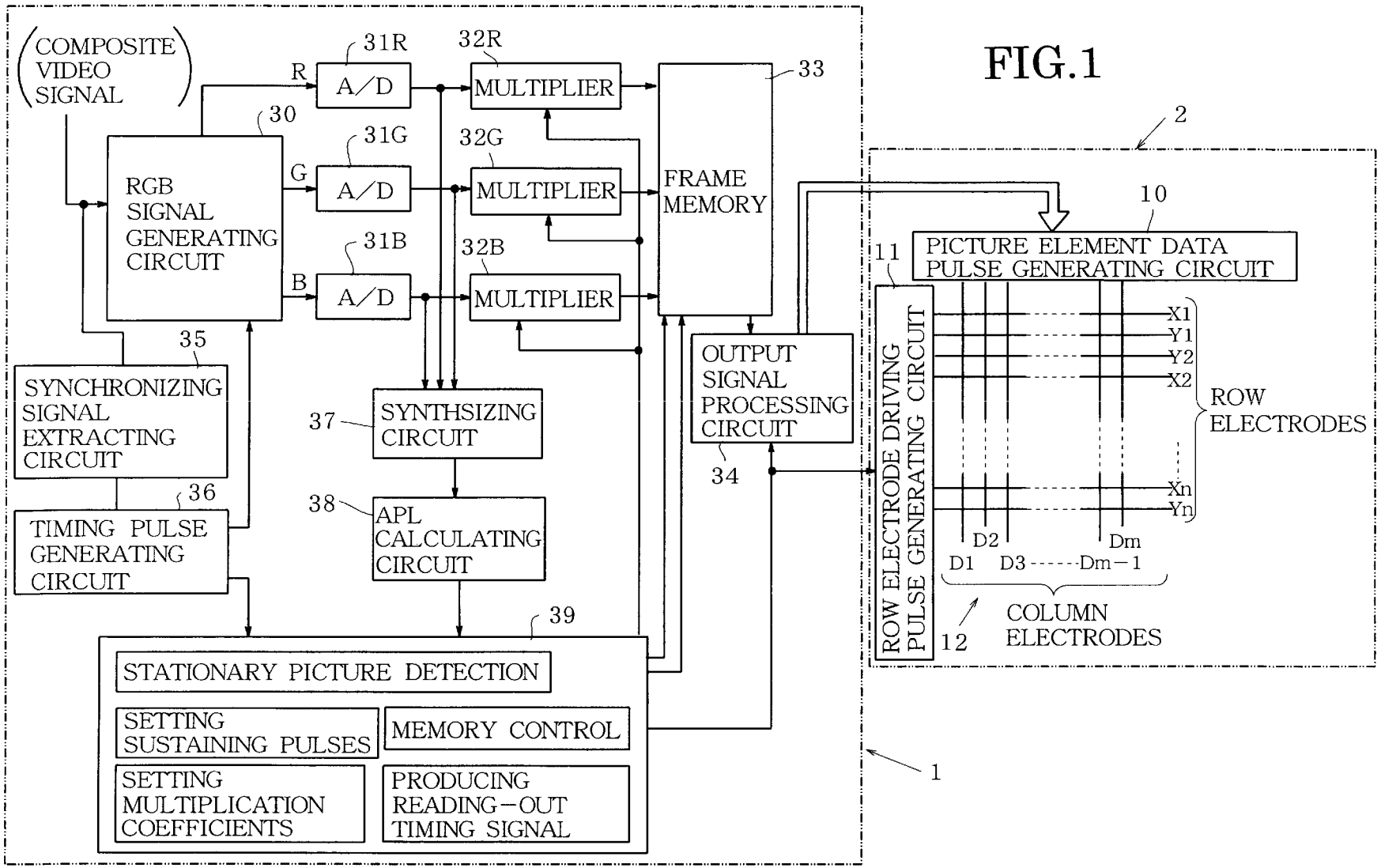
FIG.1
2
10
PICTURE ELEMENT DATA PULSE GENERATING CIRCUIT
ROW ELECTRODES
X1
Y1
Y2
X2
Xn
Yn
Dm
Dm−1
D3
D2
D1
COLUMN ELECTRODES
12
11
ROW ELECTRODE DRIVING PULSE GENERATING CIRCUIT
1
33
FRAME MEMORY
OUTPUT SIGNAL PROCESSING CIRCUIT
34
32R
MULTIPLIER
32G
MULTIPLIER
32B
MULTIPLIER
31R
A/D
31G
A/D
31B
A/D
R
G
B
30
RGB SIGNAL GENERATING CIRCUIT
COMPOSITE VIDEO SIGNAL
35
SYNCHRONIZING SIGNAL EXTRACTING CIRCUIT
36
TIMING PULSE GENERATING CIRCUIT
37
SYNTHSIZING CIRCUIT
38
APL CALCULATING CIRCUIT
39
STATIONARY PICTURE DETECTION
MEMORY CONTROL
PRODUCING READING−OUT TIMING SIGNAL
SETTING SUSTAINING PULSES
SETTING MULTIPLICATION COEFFICIENTS

FIG.14 A

PRIOR ART

| | |
|---|---|
| 1 | 128/255 |
| 2 | 200/255 |
| 3 | 128/255 |
| 4 | 200/255 |
| 5 | 128/255 |
| 6 | 200/255 |
| 7 | 128/255 |
| 8 | 200/255 |

FIG.14 B

PRIOR ART

| | |
|---|---|
| 1 | 128/255 |
| 2 | 128/255 |
| 3 | 128/255 |
| 4 | 200/255 |
| 5 | 200/255 |
| 6 | 128/255 |
| 7 | 128/255 |
| 8 | 128/255 |

FIG.14 C

PRIOR ART

| | |
|---|---|
| 1 | 64/255 |
| 2 | 64/255 |
| 3 | 64/255 |
| 4 | 100/255 |
| 5 | 100/255 |
| 6 | 64/255 |
| 7 | 64/255 |
| 8 | 64/255 |

METHOD OF AND SYSTEM FOR CONTROLLING BRIGHTNESS OF PLASMA DISPLAY PANEL

BACKGROUND OF THE INVENTION

The present invention relates to a method of and a system for controlling the brightness of a plasma display panel (hereinafter referred to as PDP), particularly for controlling the brightness of a picture reproduced from video signals and displayed on the PDP.

FIG. 10 is an explanatory view indicating a conventional driving system for driving an AC discharge type PDP whose luminescent units are arranged in a matrix manner.

As shown in FIG. 10, the conventional driving system has a signal processing section 1 for processing inputted composite video signals and for producing DVD driving signals, a display section 2 for receiving the DVD driving signals fed from the signal processing section 1 and for displaying reproduced picture on the PDP.

In the signal processing section 1, composite video signals inputted from the outside are processed in an A/D converter 3, so that said video signals will become in synchronism with a timing pulse produced from a timing pulse generating circuit 7, and are converted into 8-bit digital picture element data signals which are then fed to a frame memory 4.

The frame memory 4, in accordance with a taking-in signal and a reading-out signal both of which are all fed from a memory control circuit 8, is adapted to successively take-in picture element data from the digital picture element data signal fed from the A/D converter 3, and to read-out the taken-in picture element data which is then fed to an output signal processing circuit 5.

The output signal processing circuit 5 is provided to process the digital picture element data signal so as to produce for each field a picture element data signal having a mode (8 bit) corresponding to a brightness gradation of the filed. Then, the picture element data signal is synchronized with a timing signal fed from a timing signal generating circuit 9 and is further fed to a picture element data pulse generating circuit 10.

In the signal processing section 1, composite video signals inputted from the outside are also fed to a synchronizing signal separation circuit 6 which is provided to extract a horizontal synchronizing signal and a vertical synchronizing signal from the composite video signals. The extracted horizontal synchronizing signal and vertical synchronizing signal are then supplied to a timing pulse generating circuit 7.

The timing pulse generating circuit 7 is provided to produce various timing pulses in accordance with the above horizontal and vertical synchronizing signals. The various timing pulses are fed to the A/D converter 3, a memory control circuit 8 and a reading-out timing signal generating circuit 9.

Here, the A/D converter 3 is provided to, in synchronism with the timing pulse fed from the timing pulse generating circuit 7, perform analog/digital conversion for the composite video signals fed from the outside to the signal processing section 1.

The memory control circuit 8 is provided to produce a taking-in signal (in synchronism with a timing pulse fed from the timing pulse generating circuit 7) and a reading-out signal (in synchronism with a reading-out timing signal fed from the reading-out timing signal generating circuit 9) to the frame memory 4. Accordingly, the frame memory 4 can take-in picture element data from digital picture element data signal fed from the A/D converter 3, and can read-out the taken-in picture element data.

The reading-out timing signal generating circuit 9 receives a timing pulse fed from the timing pulse generating circuit 7, and produces a reading-out timing signal in accordance with said timing pulse. The reading-out timing signal is fed to the memory control circuit 8, the output signal processing circuit 5, further to a row electrode driving pulse generating circuit 11 of the display section 2.

In this way, the memory control circuit 8 can produce a reading-out signal to the frame memory 4, and the output signal processing circuit 5 can produce picture element data to a picture element data pulse generating circuit 10 of the display section 2.

Referring to FIG. 11, the display section 2 comprises a PDP 12 which includes a plurality of row electrodes Xi, Yi (i=1, 2 . . . n) arranged in parallel with one another on an inner surface of a front glass substrate 12A serving as a picture display panel.

Further, a dielectric layer 12B is provided to cover the row electrodes Xi, Yi (i=1, 2 . . . n). A magnesium oxide (MgO) layer 12C is formed on the dielectric layer 12B, an electric discharge space 12E is formed between the magnesium oxide layer 12C and a rear glass substrate 12D.

A plurality of column electrodes Dj (j=1, 2 . . . m) are arranged in parallel with one another on an inner surface of the rear glass substrate 12D, in a manner such that the column electrodes Dj (j=1, 2 . . . m) are perpendicular to the row electrodes Xi, Yi (i=1, 2 . . . n).

In practice, each pair of row electrodes Xi, Yi are used to form one displaying line within the PDP, each intersection formed by one pair of row electrodes Xi, Yi with one column electrode Dj forms a picture element cell.

The picture element data pulse generating circuit 11 of the display section 2 is connected with the plurality of column electrodes Dj (j=1, 2 . . . m) for producing picture element data pulses DPj(j=1, 2 . . . m) corresponding to the picture element data fed from the output signal processing circuit 5 of the signal processing section 1, said picture element data pulses DPj (j=1, 2 . . . m) being applied to the column electrodes Dj (i=1, 2 . . . m).

The row electrode driving pulse generating circuit 11 is connected with the plurality of row electrodes Xi, Yi (i=1, 2 . . . n), so as to produce the following pulses to these row electrodes Xi, Yi (i=1, 2 . . . n) in accordance with the reading-out timing signals fed from the reading-out timing signal generating circuit 9 of the signal processing section 1. In fact, the pulses produced by the row electrode driving pulse generating circuit 11 and fed to the plurality of row electrodes Xi, Yi (i=1, 2 . . . n), are reset pulses RPx, RPy for effecting an electric discharge between each pair of row electrodes Xi, Yi (i=1, 2 . . . n) to generate charged particles in the discharge space 12E, priming pulses PP for reforming the charged particles, scanning pulses SP for writing-in picture element data, sustaining pulses LPx, LPy for maintaining discharge luminescence, erasing pulses EP for erasing wall electric charges.

FIG. 12 is a timing chart indicating various timings of the above pulses to be applied to the row electrodes Xi, Yi (i=1, 2 . . . n).

As shown in FIG. 12, a reset pulse RPx of a positive voltage is applied to each of the row electrodes Xi (i=1, 2 .

. . n), while another reset pulse RPy of a negative voltage is applied to each of the row electrodes Yi (i=1, 2 . . . n). With the application of the reset pulses RPx and RPy, an electric discharge is induced in a space between each pair of row electrodes Xi, Yi (i=1, 2 . . . n), whereby generating charged particles within the electric discharge space 12E corresponding to all the picture element cells.

By virtue of the charged particles, upon completion of the electric discharge, a predetermined amount of wall charges will form in the same manner in all the picture element cells within the dielectric layer 12B.

Here, a time period until the formation of the wall charges is called an all-at-once reset period.

On the other hand, the picture element data pulse generating circuit 10 operates to successively apply picture element data pulses DPj (j=1, 2 . . . m) (each having a voltage corresponding to picture element data) to the column electrodes Dj (j=1, 2 . . . m).

As shown in FIG. 12, just before the picture element data pulse generating circuit 10 applies picture element data pulse DPj (j=1, 2 . . . m) to the column electrodes Dj (j=1, 2 . . . m), the row electrode driving pulse generating circuit 11 applies a priming pulse PP of a positive polarity to each of the row electrodes Yi (i=1, 2 . . . n). Then, a scanning pulse SP having a predetermined small pulse period and a negative polarity is successively applied to each of the row electrodes Yi (i=1, 2 . . . n), in synchronism with a timing of the picture element data pulse DPj (j=1, 2 . . . m).

With the application of the priming pulse PP, the charged particles formed in the all-at-once reset period but have decreased with the passing of time, can be increased again. Further, when the scanning pulses SP are applied during a period the charged particles are still existing, an electric potential difference between a scanning pulse SP and a picture element data pulse DPj will occur, causing a selected discharge therebetween, thereby effecting a predetermined writing-in of the picture element data.

Namely, a scanning pulse SP can serve as a trigger for selectively erasing (corresponding to picture element data) wall charges formed due to charged particles in each picture element cell within the dielectric layer 12B, thereby effecting a predetermined writing-in of the picture element data, depending upon whether or not electric discharges are caused between the row electrodes Yi (i=1, 2 . . . n) and the column electrodes Dj (j=1, 2 . . . m) and wall electrodes are thus erased.

For example, the voltage of each of the picture element data pulses DPj (j=1, 2 . . . m) applied to a picture element cells will be V (having a positive polarity) if a picture element data indicates a logic "1", but will be 0 if a picture element data shows a logic "0". On a line within the PDP 12 to which a scanning pulse SP is applied, when a picture element data indicates a logic "1", an electric potential difference between a scanning pulse SP and a picture element data pulse DPj (i=1, 2 . . . m) becomes large, thus there will be a minor electric discharge (corresponding to the period of a scanning pulse SP) between a row electrode Yi and a column electrode Dj, thereby erasing wall charges in the dielectric layer 12B corresponding to picture element cells. At this moment, since a time for the electric discharge is short, there would be no wall charges newly formed in the dielectric layer 12B.

On the other hand, when the picture element data (corresponding to picture element cell) indicates a logic "0", an electric potential difference between a scanning pulse SP and a picture element data pulse DPj (i=1, 2 . . m) is small. As a result, there will not be any electric discharge between a row electrode Yi and a column electrode Dj, rendering wall charges to remain within the dielectric layer 12B corresponding to picture element cells.

Here, a period necessary for writing-in the picture element data by virtue of the erasing of the wall charges is called an address period.

Next, the row electrode driving pulse generating circuit 11 operates to continuously apply a sustaining pulse LPx of positive polarity to each row electrode Xi, and continuously apply a sustaining pulse LPy of positive polarity to each row electrode Yi in a timing slightly later than a timing for applying the pulse LPx.

With the application of the sustaining pulses LPx and LPy, discharge luminescence occurs only in picture element cells where wall charges are remaining within the dielectric layer 12B. Such discharge luminescence may be maintained during a period when the sustaining pulses LPx and LPy are being applied continuously.

By virtue of such discharge luminescence, a picture will then be displayed on the PDP 12.

Here, a period during which the discharge luminescence is maintained by continuously applying sustaining pulses LPx and LPy is called a discharge maintaining period.

After the discharge luminescence has been maintained for a predetermined period, the row electrode driving pulse generating circuit 11 operates to apply an erasing pulse EP having a negative polarity to each row electrode Yi, so as to erase the wall charges remaining in the dielectric layer 12B, thereby finishing the display of one field of picture.

However, with an AC discharge type matrix display PDP, since there is a significant temperature difference between portions of discharge luminescence and the portions of non-discharge luminescence, a problem such as cracking might occur on the PDP.

In order to prevent a possible cracking on a PDP, there has been suggested an Automatic Brightness/Beam Limiter for limiting a picture brightness when displaying a stationary picture on a display panel, as disclosed in the applicant's earlier application (Japanese Patent Application No. 9-187827).

FIG. 13 is a block diagram indicating a brightness limiting system disclosed by the applicant in the above-mentioned earlier application. With such a brightness limiting system, a composite video signal is decomposed into various analogue color signals R, G, B (Red, Green, Blue) by virtue of a color signal generating circuit (not shown).

As shown in FIG. 13, the color signals R, G, B are applied to A/D converters 20R, 20G, 20B to be converted into digital signals which are further fed to multipliers 21R, 21G, 21B in which each digital signal is multiplied by a multiplication coefficient, thereby setting brightness levels of various color signals R, G, B.

The various color signals R, G, B, whose brightness levels have been set, are fed to a frame memory (not shown) and further to an output signal processing circuit (not shown) so as to be applied to a display section (not shown), in the same manner as shown in FIG. 10.

However, the multiplication coefficients for use in setting the brightness levels of various color signals R, G, B may be determined in the following way.

Namely, color signals R, G, B, which have been converted into digital signals in A/D converters 20R, 20G and 20B, are fed to a synthesizing circuit 22 so as to be synthesized with a brightness signal. The systhesized signal is then fed to an APL (Average Picture Level) calculating circuit 23.

The APL calculating circuit 23 is provided to divide video signal of one field picture into eight blocks in vertical direction (see FIG. 14) and to calculate an APL value for each block. The APL values are then fed to an APL adder circuit 24.

The APL adder circuit 24 is provided to adder together the APL values of two adjacent blocks to obtain an added APL value to be fed to a comparator circuit 25.

The comparator circuit 25 is provided to compare an added APL value with a reference value set in advance in a reference value generating circuit 26, with a comparing result fed to a multiplication coefficient setting circuit 27.

The multiplication coefficient setting circuit 27 operates to set multiplication coefficients for multipliers 21R, 21G, 21B, in accordance with comparison results fed from the comparator circuit 25. Namely, if an added APL value is larger than a reference value, a multiplication coefficient (preset in the circuit 27 and smaller than 1), will be fed to each of the multipliers 21R, 21G, 21B. The multipliers 21R, 21G, 21B will thus operate to multiply the color signals R, B, G with the multiplication coefficient, so as to reduce the brightness level of color signals R, B, G.

On the other hand, if each of added APL values is smaller than a reference value, a multiplication coefficient (preset in the circuit 27 and equal to 1), will be fed to each of the multipliers 21R, 21G, 21B, so as not to reduce the brightness level of color signals R, B, G.

For instance, if a reference value preset in the circuit 26 is 400, in a pattern of FIG. 14A (in which numerical numbers are used to represent APL values of the blocks), since each of added APL values of two adjacent blocks is smaller than 400, only a multiplication coefficient equal to 1 is outputted from the multiplication coefficient generating circuit 27, so as not to reduce the brightness level of color signals R, B, G.

On the other hand, as shown in a pattern of FIG. 14B, if an added APL value of two adjacent blocks (block 4 and block 5) is larger than the preset reference value 400, multiplication coefficient preset in the circuit 27 and smaller than 1 (for example 0.5), will be fed to the multipliers 21R, 21G, 21B. The multipliers 21R, 21G, 21B will operate to multiply the color signals R, B, G with the multiplication coefficient (0.5), so as to reduce the brightness level of various color signals, as shown in FIG. 14C (APL value of each block has been reduced to ½ of its original value).

With the use of the above brightness control system, it is possible to reduce the picture brightness on some areas of a PDP where bright picture portions are collected, thereby preventing occurence of cracking on the PDP.

However, it has been proved that the above conventional brightness control system (Automatic Brightness/Beam Limiter) is effective only in a case where a bright portion $\alpha$ of a stationary picture is collecte in a leteral direction (see FIG. 15), but is not effective in a case where a bright portion a of a stationary picture is collected in a vertical direction (see FIG. 16). The reason responsible for the case of FIG. 16 is that APL values of all the blocks are low, an added APL value of every two adjacent blocks is lower than a predetermined reference value, hence disabling the brightness control system (Automatic Brightness/Beam Limiter), and making it impossible to prevent a cracking in a PDP.

SUMMARY OF THE INVENTION

It is an object of the present invention to provide an improved method of controlling the brightness of a PDP (plasma display panel), capable of preventing a cracking on the PDP, regardless of what pattern of a stationary picture is displayed on the PDP, thereby solving the above-mentioned problems peculiar to the above-discussed prior arts.

According to the present invention, there is provided a method of controlling a brightness of a picture displayed on a plasma display panel by increasing or decreasing said brightness, said method comprising: determining whether a video signal to be fed to the plasma display panel is a signal indicating a stationary picture; reducing the brightness of a picture displayed on the plasma display panel if it is determined that a video signal to be fed to the plasma display panel is a signal indicating a stationary picture.

In one aspect of the present invention, one average brightness level of a video signal to be fed to the plasma display panel is detected during a predetermined period, said one average brightness level is then compared with a former average brightness level detected immediately before the detection of said one average brightness level, so as to obtain a difference between said one average brightness level and said former average brightness level.

In another aspect of the present invention, when the difference between said one average brightness level and said former average brightness level is smaller than a predetermined value and such condition has continued for a predetermined time, it is determined that said video signal is a signal indicating a stationary picture.

In a further aspect of the present invention, when it is determined that a video signal to be fed to the plasma display panel is a signal indicating a stationary picture, the number of sustaining pulses for maintaining luminescent discharge on the plasma display panel is reduced.

In a still further aspect of the present invention, the number of sustaining pulses for maintaining luminescent discharge on the plasma display panel is reduced gradually step by step.

In one more aspect of the present invention, when it is determined that a video signal to be fed to the plasma display panel is a signal indicating a stationary picture, multiplication coefficients are made smaller which will be multiplied with video signals to be fed to the plasma display panel to adjust the brightness of the stationary picture displayed on the plasma display panel.

Further, according to the present invention, there is provided a system for controlling a brightness of a picture displayed on a plasma display panel by increasing or decreasing said brightness, said system comprising: determining means for determining whether a video signal to be fed to the plasma display panel is a signal indicating a stationary picture; brightness reducing means for reducing the brightness of a picture displayed on the plasma display panel if it is determined that a video signal to be fed to the plasma display panel is a signal indicating a stationary picture.

In one more aspect of the present invention, the above determining means comprises: average brightness level detecting means for detecting during a predetermined period one average brightness level of a video signal to be fed to the plasma display panel; calculating means for comparing said one average brightness level with a former average brightness level detected immediately before the detection of said one average brightness level and for obtaining a difference between said one average brightness level and said former average brightness level; monitor means for monitorring whether the difference obtained by the calculating means has continuously been smaller than a predetermined value for a predetermined time. In particular, when the monitor means determines that the difference obtained by the calculating means has continuously been smaller than a predetermined value for a predetermined time, it is determined that said video signal is a signal indicating a stationary picture.

In still one more aspect of the present invention, the brightness reducing means is means capable of reducing the number of sustaining pulses for maintaining luminescent discharge on the plasma display panel.

In still one more aspect of the present invention, the brightness reducing means is capable of reducing the number of the sustaining pulses gradually step by step.

In still one more aspect of the present invention, the brightness reducing means is means capable of reducing multiplication coefficients to be multiplied by video signals to be fed to the plasma display panel so as to adjust the brightness level of the video signals.

The above objects and features of the present invention will become better understood from the following description with reference to the accompanying drawings.

BRIEF DESCRIPTION OF DRAWINGS

FIG. 1 is a block diagram indicating a system of the present invention for control ling the brightness of a plasma display panel.

FIGS. 14A through 14C are used to indicate how to reduce the brightness of a plasma display panel using a method and a system according to a prior art.

DETAILED DESCRIPTION OF THE PREFERRED EMBODIMENTS

Figure 2:
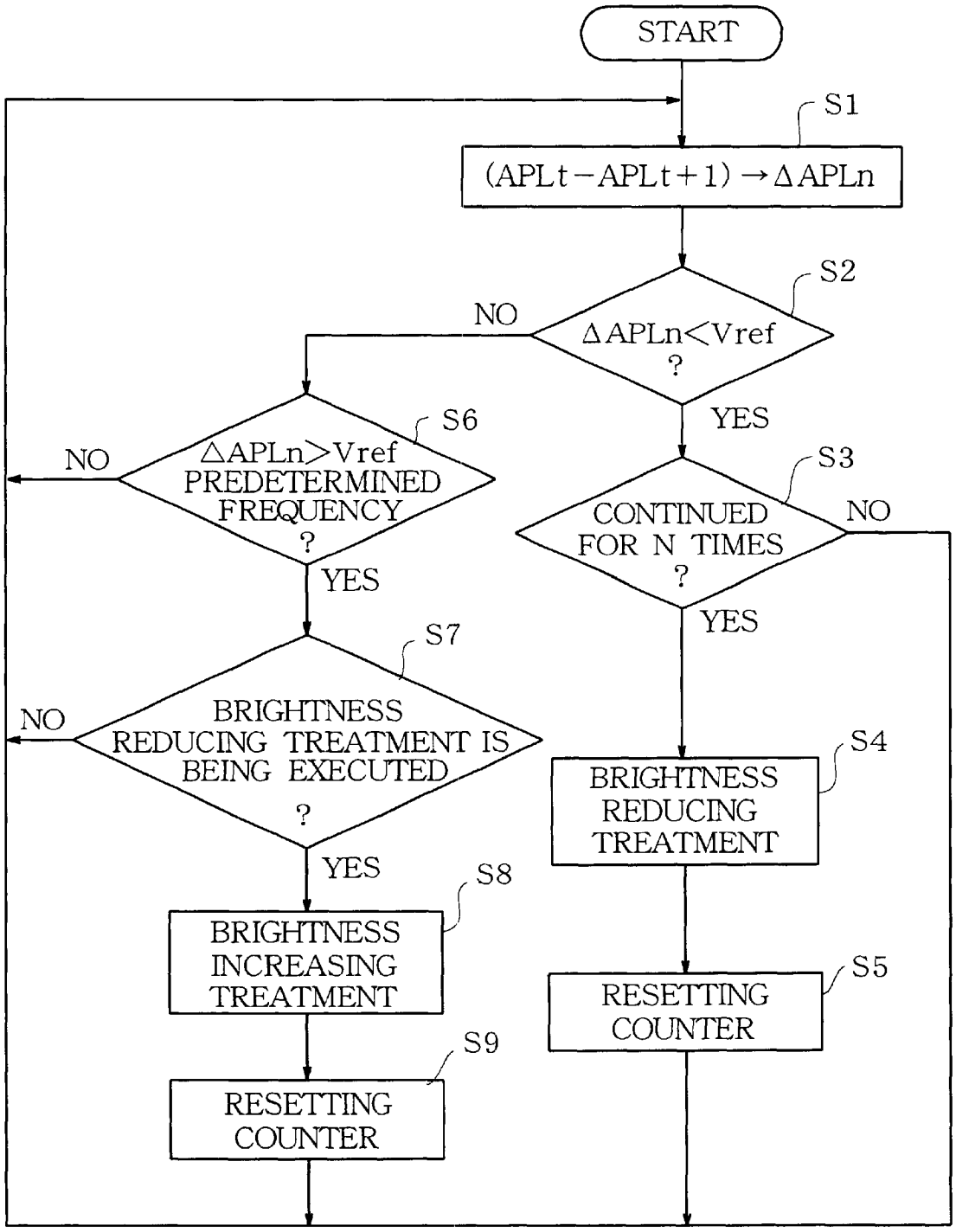
FIG. 2 is a flowchart indicating a procedure for determining whether a picture displayed on a display is a stationary picture.

Referring to FIG. 1, a PDP driving system in which the present invention has been applied, includes a signal processing section 1 and a display section 2.

The signal processing section 1 comprises an RGB (Red, Green, Black) color signal generating circuit 30 capable of separating a composite video signal (fed from the outside) into various analogue color signals (Red, Green, Black), A/D converters 31R, 31G, 31B for converting various analogue color signals of PGB into digital signals, multipliers 32R, 32G, 32B for multiplying the digital color signals R, G, B with required multiplication coefficient, a frame memory 33 capable of taking-in picture element data from the digital color signals (multiplied with the multiplication coefficient) and capable of reading-out the picture element data, an output data processing circuit 34 capable of converting digital signal of picture element data read from the frame memory 33 into picture element data signal of a mode (8 bit) corresponding to a brightness gradation in each field and capable of feeding such picture element data signal into the display section 2, a synchronizing signal extracting circuit 35 capable of extracting a horizontal synchronizing signal and a vertical synchronizing signal from the composite video signal, a timing pulse generating circuit 36 for generating a timing pulse in accordance with the extracted horizontal synchronizing signal and a vertical synchronizing signal, a synthesizing circuit 37 for synthesizing the digital color signals R, G, B to produce a brightness signal, an APL (Average Picture Level) calculating circuit 38 for calculating an APL (for every vertical scanning period) in accordance with the brightness signal, and a controller 39 capable of determining whether a picture displayed on the PDP is a stationary picture so as to set a multiplication coefficient in accordance with the calculated APL, and capable of controlling an operation timing of the frame memory 33, the output signal processing circuit 34 and the display section 2.

Figure 10:
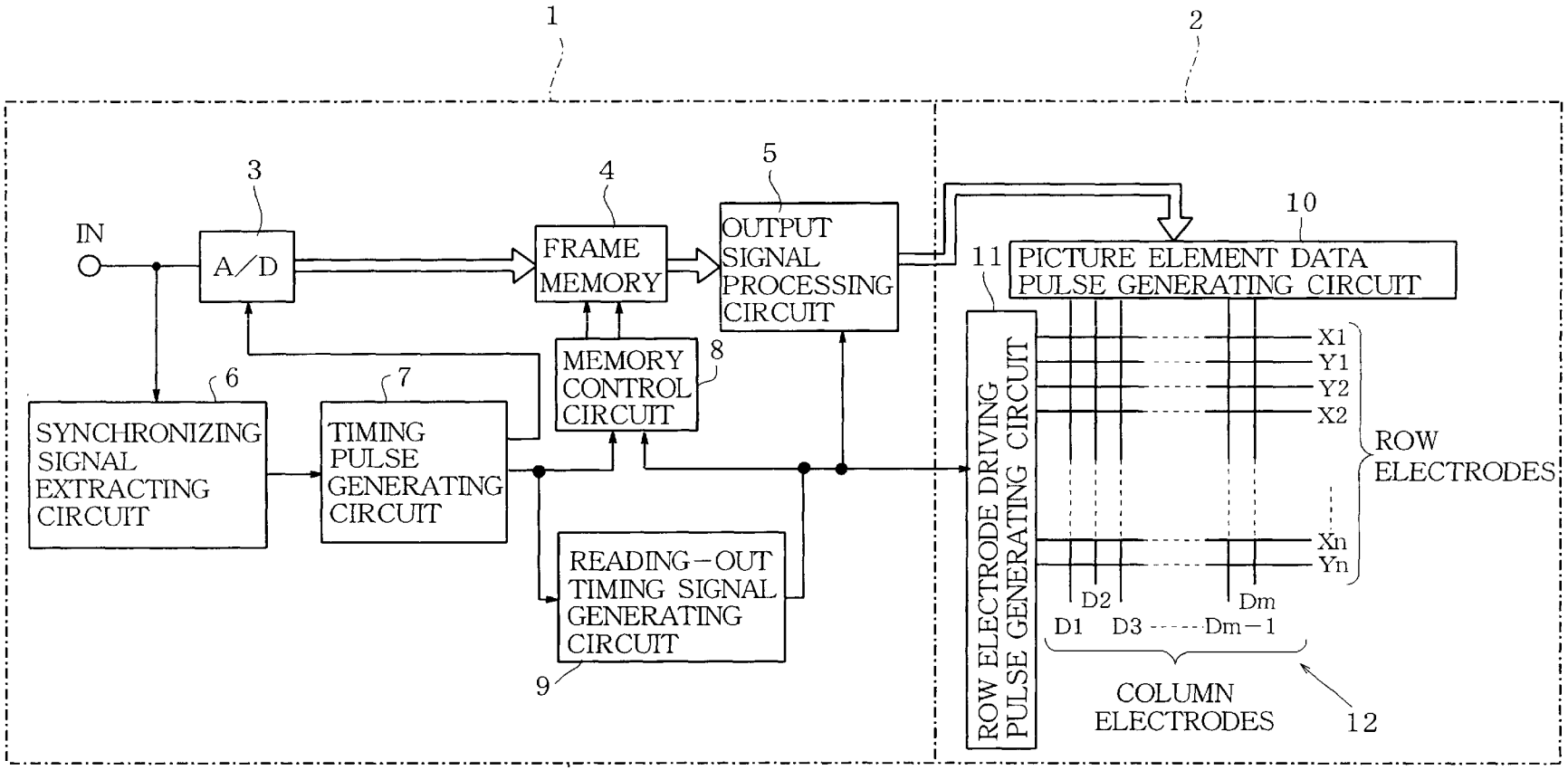
FIG.10 PRIOR ART
FIG. 10 is a block diagram indicating a system of a prior art for controlling the brightness of a plasma display panel.
Figure 11:
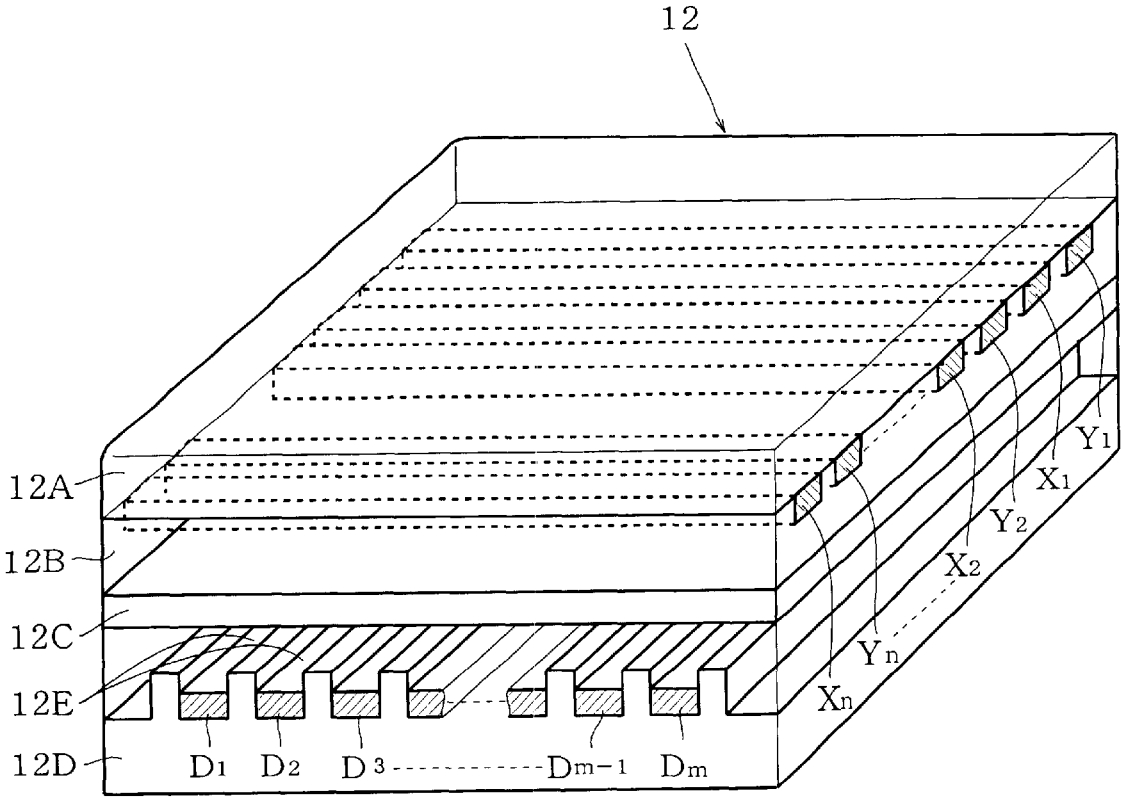
FIG.11 PRIOR ART
FIG. 11 is a perspective view indicating the structure of a plasma display panel to be driven by using a method and a system according to a prior art.

The display section 2 is just the same as that discussed in prior art shown in FIG. 10, including a picture element data pulse generating circuit 10, a row electrode driving pulse generating circuit 11, and a PDP 12.

Here, the synchronizing signal extracting circuit 35 can extract a horizontal synchronizing signal and a vertical synchronizing signal from the composite video signal and apply these synchronizing signals to the timing pulse generating circuit 36. The timing pulse generating circuit 36 then generates the timing pulse in accordance with the horizontal synchronizing signal and the vertical synchronizing signal and applies the timing pulse to the RGB generating circuit 30 and controller 39.

The RGB generating circuit 30 is provided to separate the composite video signal into RGB analogue signals in synchronism with the timing pulse fed from the timing pulse generating circuit 36.

Then, the color signals R, G, B are applied to A/D converters 31R, 31G, 31B to be converted into digital signals which are further fed to multipliers 32R, 32G, 32B in which each digital signal is multiplied with a multiplication coefficient, thereby setting brightness levels of various color signals R, G, B.

The various digital color signals R, G, B, whose brightness levels have been set, are fed to the frame memory 33, and their picture element data are successively fed to the frame memory 33 in synchronism with taking-in signal supplied from the controller 39.

The picture element data fed into the frame memory 33 are then read out therefrom in synchronism with reading-out signal fed from the controller 39, and fed to the output data processing circuit 34 in which the picture element data are converted into picture element data signal of a mode (8 bits) corresponding to brightness gradation in each field. The picture element data signal are fed to the picture element data pulse generating circuit 10 of the display section 2, in synchronism with reading-out timing signal fed from the controller 39.

The controller 39 is capable of determining whether a picture displayed on the PDP of the display section 2 is a stationary picture or not, and thus controlling the brightness of the PDP 12 in accordance with the result of said determination.

Namely, the digital color signals R, G, B supplied from the A/D converters 31R, 31G, 31B are fed into the synthesizing circuit 37 in which these digital color signals are combined with brightness signal, and the combined signal is supplied to the APL calculating circuit 38.

The APL calculating circuit 38 can calculate an APL in every vertical scanning period for displaying a picture on the PDP, while a signal indicating the calculated APL value is fed to the controller 39.

Referring to FIG. 1, the controller 39 is fabricated so that it is capable of determining whether a picture displayed on the PDP is a stationary picture, with the determination being conducted in accordance with the calculated APL; setting the number of sustaining pulse to be fed from the row electrode driving pulse generating circuit 11, in accordance with the result of said determination; setting multiplication coefficient to be multiplied by the digital color signals R, G, B in the multipliers 32R, 32G, 32B, also in accordance with the result of the above determination.

Further, the controller 39 has a memory control function and a reading-out timing signal generating function. The memory control function is capable of controlling a timing for the frame memory 33 to take-in picture element data from the out timing signal to be fed to the output signal processing circuit 34 and the row electrode driving pulse generating circuit 11 of the display section 2, corresponding to the number of timing pulses fed from the timing pulse generating circuit 36 or the number of sustaining pulses which have been set in advance.

A procedure for brightness control effectable by using the controller 39 may be described with reference to flowcharts shown in FIGS. 2–6.

Referring to FIG. 2, the controller 39 operates to store an APL value (of every vertical scanning period) fed from the APL calculating circuit 38, and to calculate a difference ΔAPLn (APLt−APLt+1) between the APL value fed at this time and an APL value fed at the last time (step S1). Then, the difference ΔAPLn is compared with a reference value Vref set in advance so as to determine whether the difference ΔAPLn is larger or smaller than the reference value Vref (step S2).

If it is determined that the ΔAPLn is smaller than the reference value Vref, it is further determined whether said determination indicating the difference ΔAPLn is smaller than the reference value Vref has been repeated for n times (step S3).

If it is determined at step S3 that said determination indicating the difference ΔAPLn is smaller than the reference value Vref has not been repeated for n times, the program goes back to step S1 to repeat the process beginning with the step S1. On the other hand, if it is determined at step S3 that said determination indicating the difference ΔAPLn is smaller than the reference value Vref has been repeated for n times, it is allowed to determine that the picture displayed on the PDP 12 is a stationary picture, thereby executing a brightness reducing treatment (step S4) that will be described in detail later.

Afterwards, a counter is reset (step S5) for counting the number of times for the determination executed at step S3, while the program returns to step S1 so as to repeat the process beginning with the step S1.

On the other hand, if it is determined at step S2 that the ΔAPLn is larger than the reference value Vref, it is further determined whether said determination indicating the difference ΔAPLn is larger than the reference value Vref has been repeated with a predetermined frequency in a predetermined period. If it is determined that said determination indicating the difference ΔAPLn is larger than the reference value Vref has been repeated with a predetermined frequency in a predetermined period, it is allowed to determine that the picture displayed on the PDP 12 is a motion picture (step S6).

If it is determined at step S6 that said determination indicating the difference ΔAPLn is larger than the reference value Vref has not been repeated with a predetermined frequency in a predetermined period, the program goes back to step S1 to repeat the process beginning with the step S1.

If it is determined at step S6 that the picture displayed on the PDP 12 is a motion picture, it is further determined at a step S7 whether a brightness reducing treatment at step S4 is just in a process of being executed.

If it is determined at the step S7 that a brightness reducing treatment at step S4 is not in a process of being executed, the program goes back to step S1 to repeat the process beginning with the step S1. On the other hand, if it is determined that a brightness reducing treatment at step S4 is just in a process of being executed, said brightness reducing treatment is stopped and a brightness increasing treatment is executed at step S8.

Then, a counter is reset (step S9) for counting the frequency of determination executed at step S6, while the program returns to step S1 so as to repeat the process beginning with the step S1.

A procedure for brightness reducing treatment Performed at step S4 may be described in the following.

Figure 3:
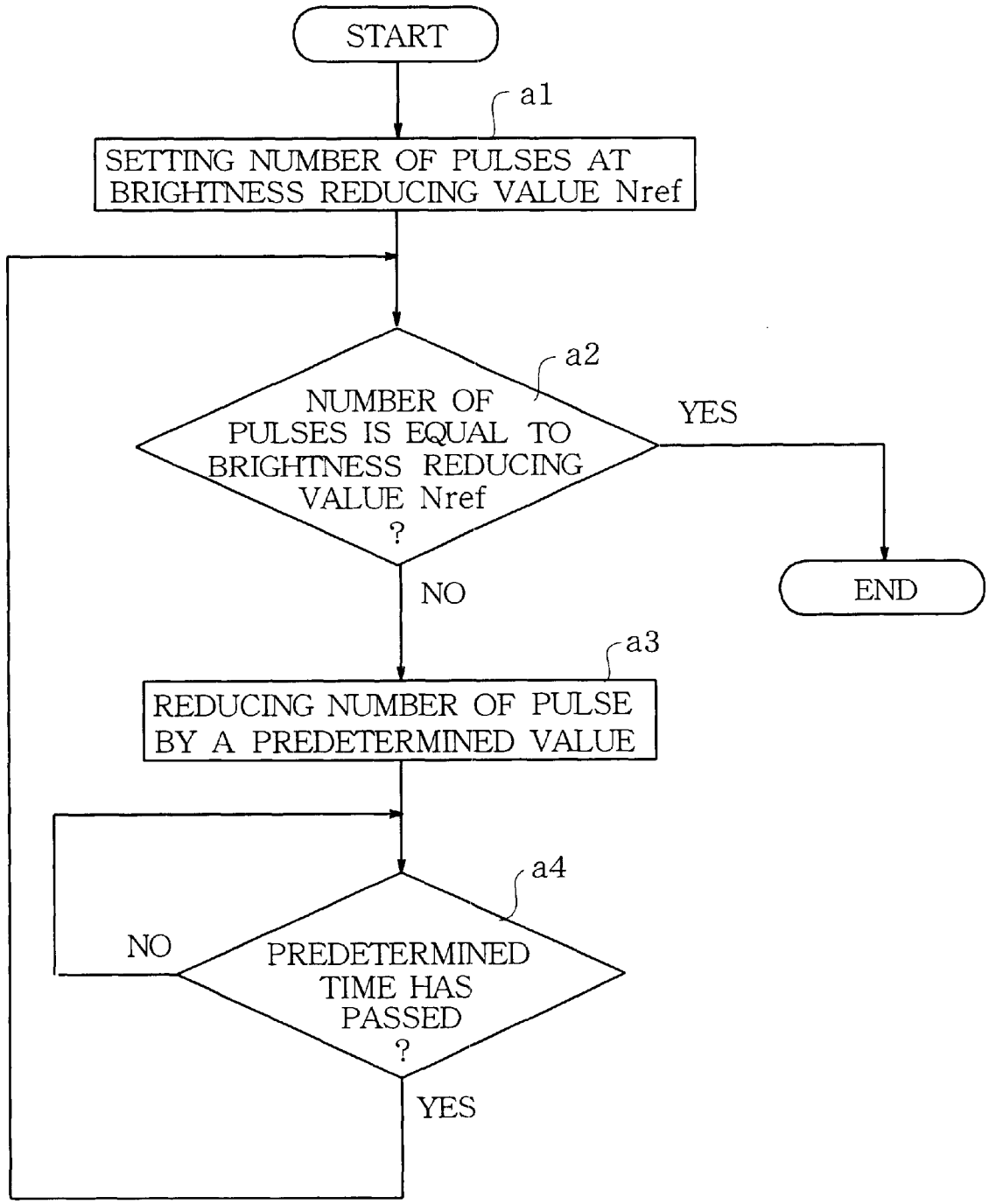
FIG. 3 is a flowchart indicating a procedure for reducing the brightness of the plasma display panel.
Figure 4:
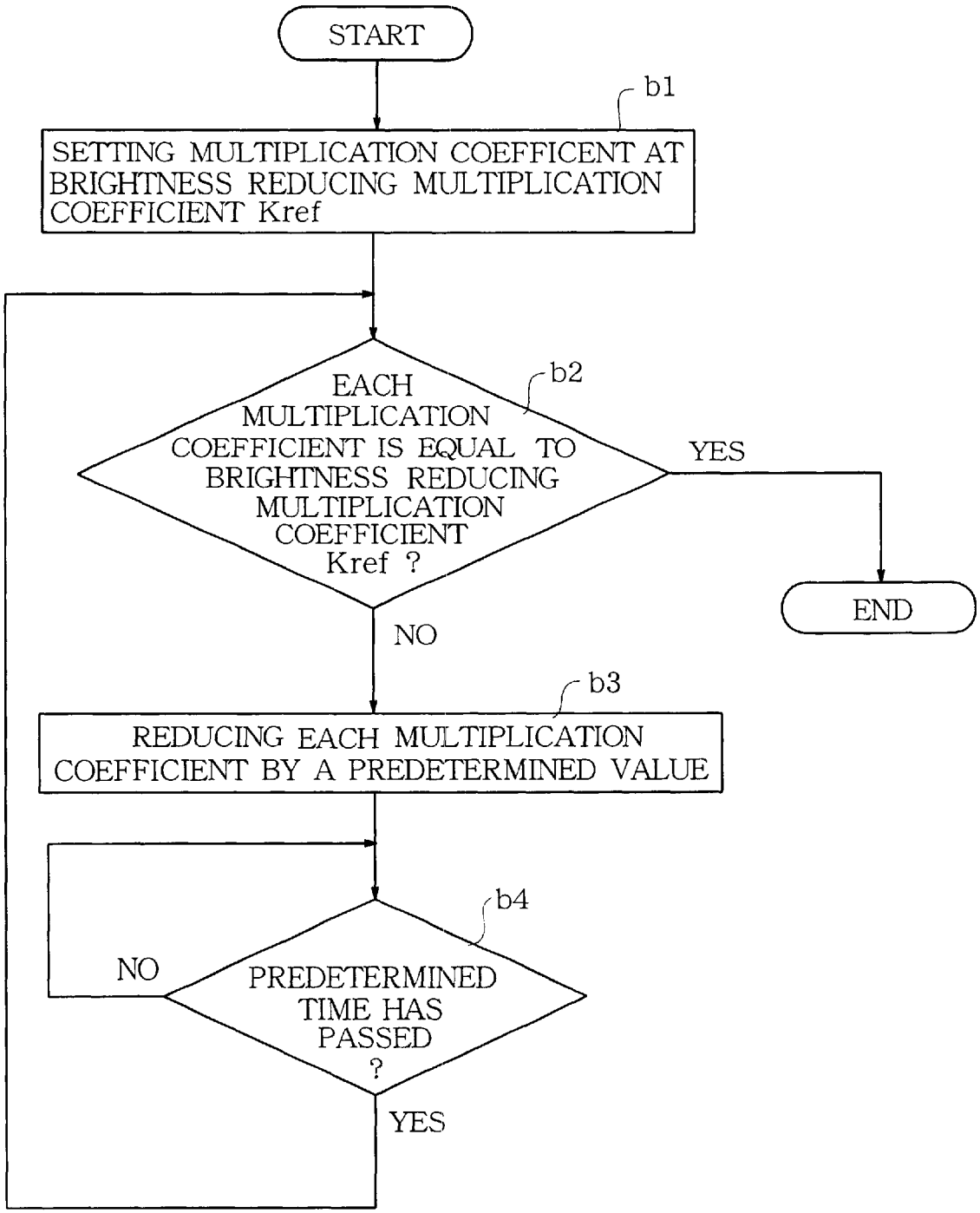
FIG. 4 is a flowchart indicating another procedure for reducing the brightness of the plasma display panel.

In fact, there are two kinds of methods for performing the brightness reducing treatment, with one being shown in FIG. 3 and the other in FIG. 4. In detail, the two methods may be mutually changed-over automatically or manually.

In a method shown in FIG. 3, the number of sustaining pulses applied from the row electrode driving pulse generating circuit 11 to the row electrodes Xi, Yi (i=1, 2 . . . n) of the PDP 12 is reduced so as to reduce the number of times for discharge luminescence, thereby reducing the brightness of a picture displayed on the PDP 12.

Namely, once the brightness reducing treatment at step S4 in FIG. 2 is decided to be executed, the number of sustaining pulses is set (step al in FIG. 3) at a brightness reducing value Nref which is lower than an initial value N1 for indicating a motion picture.

Then, it is determined at step a2 whether the number of the sustaining pulses applied from the row electrode driving pulse generating circuit 11 to the row electrodes Xi, Yi (i=1, 2 . . . n) of the PDP 12 has been set at the brightness reducing value Nref (step a2).

If it is determined at the step a2 that the number of the sustaining pulses has already been set at the brightness reducing value Nref, it is understood that the brightness reducing treatment is just in its process of being executed. On the other hand, if it is determined at step a2 that the number of the sustaining pulses has not been set at the brightness reducing value Nref, the row electrode driving pulse generating circuit 11 is controlled (at step a3) to reduce the number of sustaining pulses being applied to PDP 12 by a predetermined number, in accordance with a reading-out timing signal applied to the row electrode driving pulse generating circuit 11.

Then, it is determined at a step a4 whether a predetermined time for reducing the number of sustaining pulses has passed. If it is determined that said predetermined time has passed, the program returns to the step a2 so as to repeat the process beginning with step a2.

Figure 7:
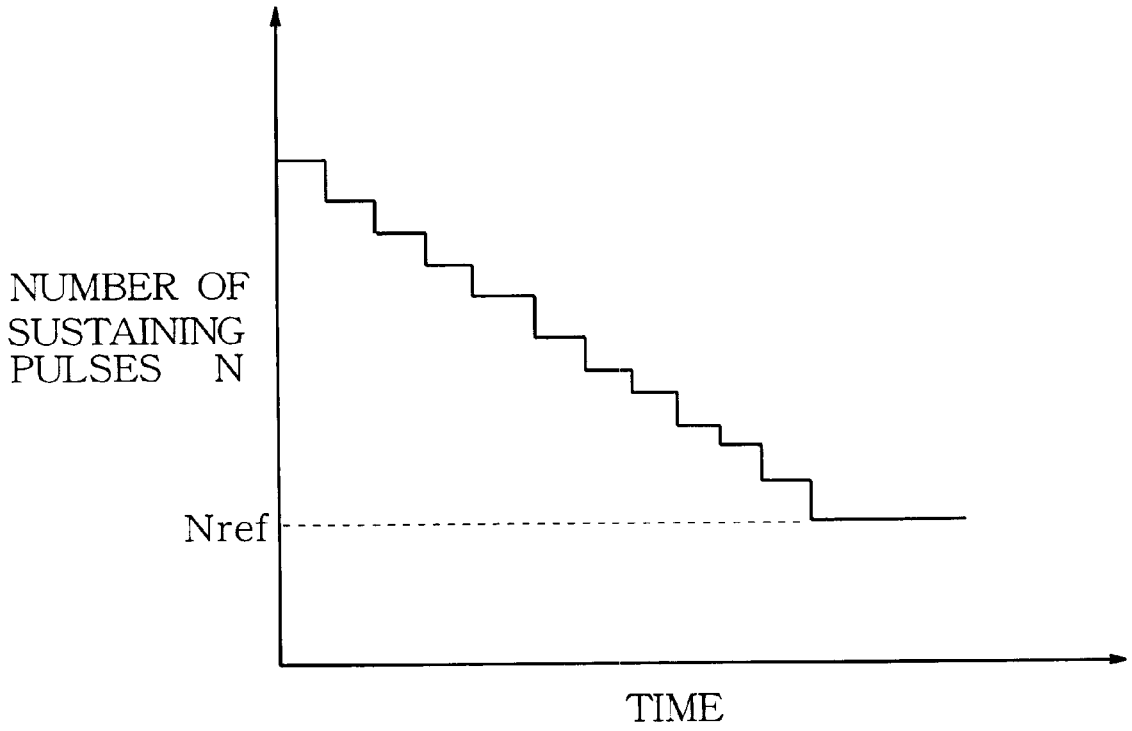
FIG. 7 is a graph indicating a condition where the number of sustaining pulses is reduced by using a procedure shown in FIG. 3.

However, when the program is at the step a3, it is required that the number of sustaining pulses should not be reduced all at once. Further, a step (to determine whether a predetermined time for reducing the number of sustaining pulses has passed) performed at at step a4 is useful in obtaining an effect that the reduction of the number of the sustaining pulses will be gradual as shown in FIG. 7, thereby preventing a sudden darkening of a picture displayed on the PDP 12.

Subsequently, the steps a2–a4 are repeated so that the number of sustaining pulses fed from the row electrode driving pulse generating circuit 11 is reduced gradually. At this moment, if it is determined at the step a2 that the number of the sustaining pulses has been reduced to the brightness reducing value Nref, the reducing process is stopped, so that the number of the sustaining pulses are maintained at the brightness reducing value Nref.

Here, if the PDP driving system employs a gradation displaying method involving the use of sub-fields, it is particularly important that the number of sustaining pulses be gradually reduced to a brightness reducing value set in advance.

Figure 8:
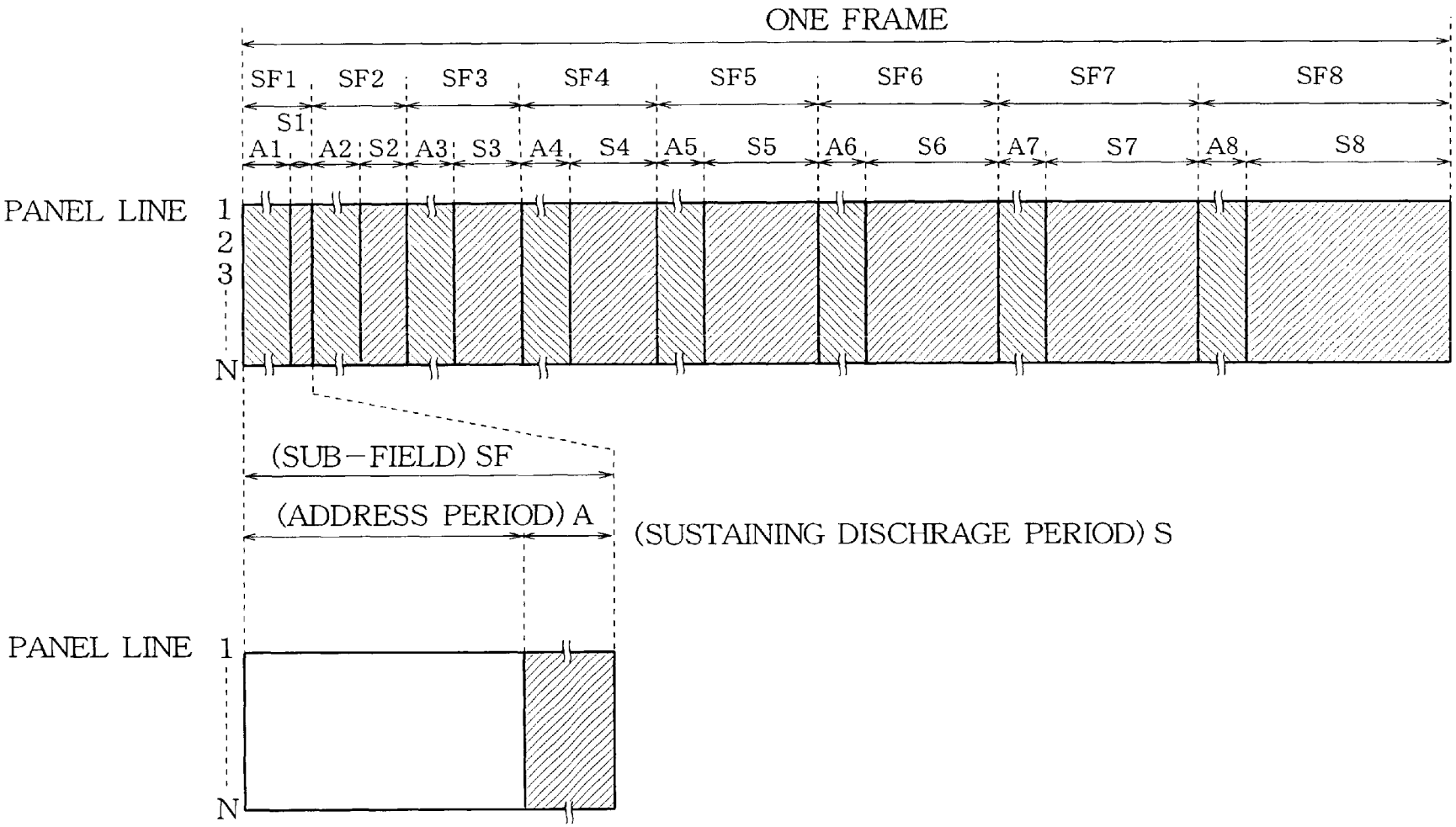
FIG. 8 is an explanatory view indicating one frame picture on gradation display.

For example, in a case of 256-step gradation display shown in FIG. 8, one frame has 8 sub-fileds SFr (r=1, 2 . . . 8), including address periods Ar (r=1, 2 . . . 8) and sustaining discharge period Sr (r=1, 2 . . . 8). The number of sustaining discharges during the sustaining discharge periods Sr (r=1, 2 . . . 8) of 8 sub-fileds SFr (r=1, 2 . . . 8), may be set to be in a ratio of 1:2:4:8:16:64:128.

The number of sustaining discharges during sustaining discharge periods Sr (r=1, 2 . . . 8) are proportional to the brightness of PDP. Thus, by properly selecting sub-fields for sustaining discharge, it is allowed to obtain a desired brightness of 256 steps.

Therefore, in the PDP driving system employing a gradation displaying method, the number of sustaining discharge (the number of sustaining pulse) in each sub-field may be reduced to a brightness reducing value set in advance for each sub-field, it is sure to perform a desired brightness reducing treatment.

In a method shown in FIG. 4 which employs a forced operation of ABL (Automatic Brightness Limiter), the multiplication coefficients to be multiplied with digital color signals R, G, B are made small.

Namely, once the brightness reducing treatment at step S4 in FIG. 2 is decided to be executed, multiplication coefficients to be multiplied with the digital color signals R, G, B in the multipliers 32R, 32G, 32B are each set (step b1 in FIG. 4) at a brightness reducing multiplication coefficient Kref which is lower than an initial value K1 for indicating a motion picture.

Then, it is determined at a step b2 whether the multiplication coefficients set in the multipliers 32R, 32G, 32B are each equal to the brightness reducing multiplication coefficient Kref.

If it is determined at the step b2 that the multiplication coefficients set in the multipliers 32R, 32G, 32B are each equal to the brightness reducing multiplication coefficient Kref, it is understood that the brightness reducing treatment is just in its process of being executed. On the other hand, if it is determined at step b2 that the multiplication coefficients set in the multipliers 32R, 32G, 32B are not equal to the brightness reducing multiplication coefficient Kref, the multiplication coefficients to be multiplied with digital color signals R, G, B in the multipliers 32R, 32G, 32B are each reduced by a predetermined value (step b3).

Then, it is determined at a step b4 whether a predetermined time for reducing the multiplication coefficients has passed. If it is determined that said predetermined time has passed, the program returns to the step b2 so as to repeat the process beginning with step b2.

Figure 9:
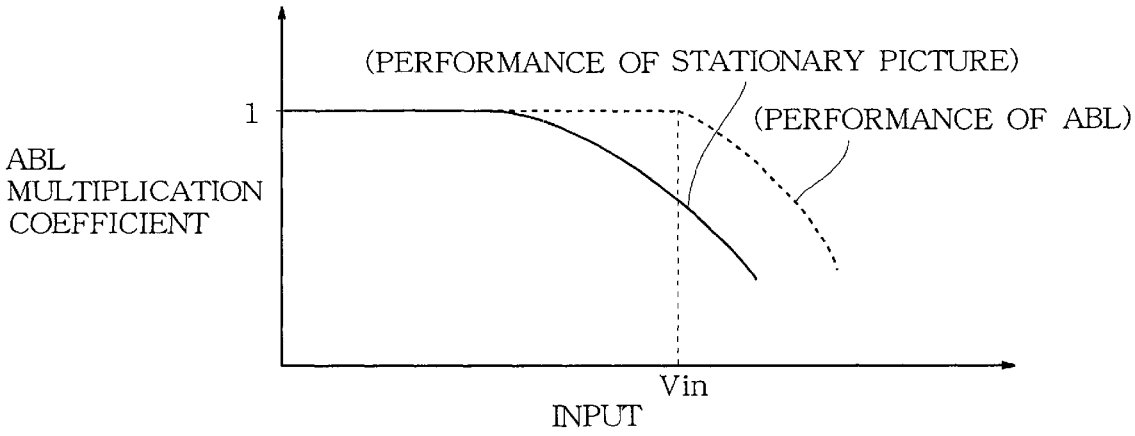
FIG. 9 is a graph indicating performance of stationary picture and performance of ABL when multiplication coefficients are reduced by using a procedure shown in FIG. 4.

However, when the program is at the step b3, it is required that the multiplication coefficients to be multiplied with digital color signals R, G, B in the multipliers 32R, 32G, 32B should not be reduced to be equal to the brightness reducing multiplication coefficient Kref all at once. Further, an operation (to determine whether a predetermined time for reducing the multiplication coefficients has passed) performed at the step b4 is useful in obtaining an effect of preventing a sudden darkening of a picture displayed on the PDP 12 by avoiding a sudden reduction in the brightness. FIG. 9 is a graph indicating a performance of a stationary picture and a performance of ABL at this moment.

Subsequently, the steps b2–b4 are repeated so that the the multiplication coefficients to be multiplied with digital color signals R, G, B in the multipliers 32R, 32G, 32B are reduced gradually. At this moment, if it is determined at the step b2 that each of the multiplication coefficients preset in the multipliers 32R, 32G, 32B has already become equal to the brightness reducing multiplication coefficient Kref, the reducing process is stopped, so that the multiplication coefficients are each maintained at the brightness reducing multiplication coefficient Kref.

Now, a procedure for performing a brightness increasing treatment at the step S8 of FIG. 2 will be described in detail below.

Figure 5:
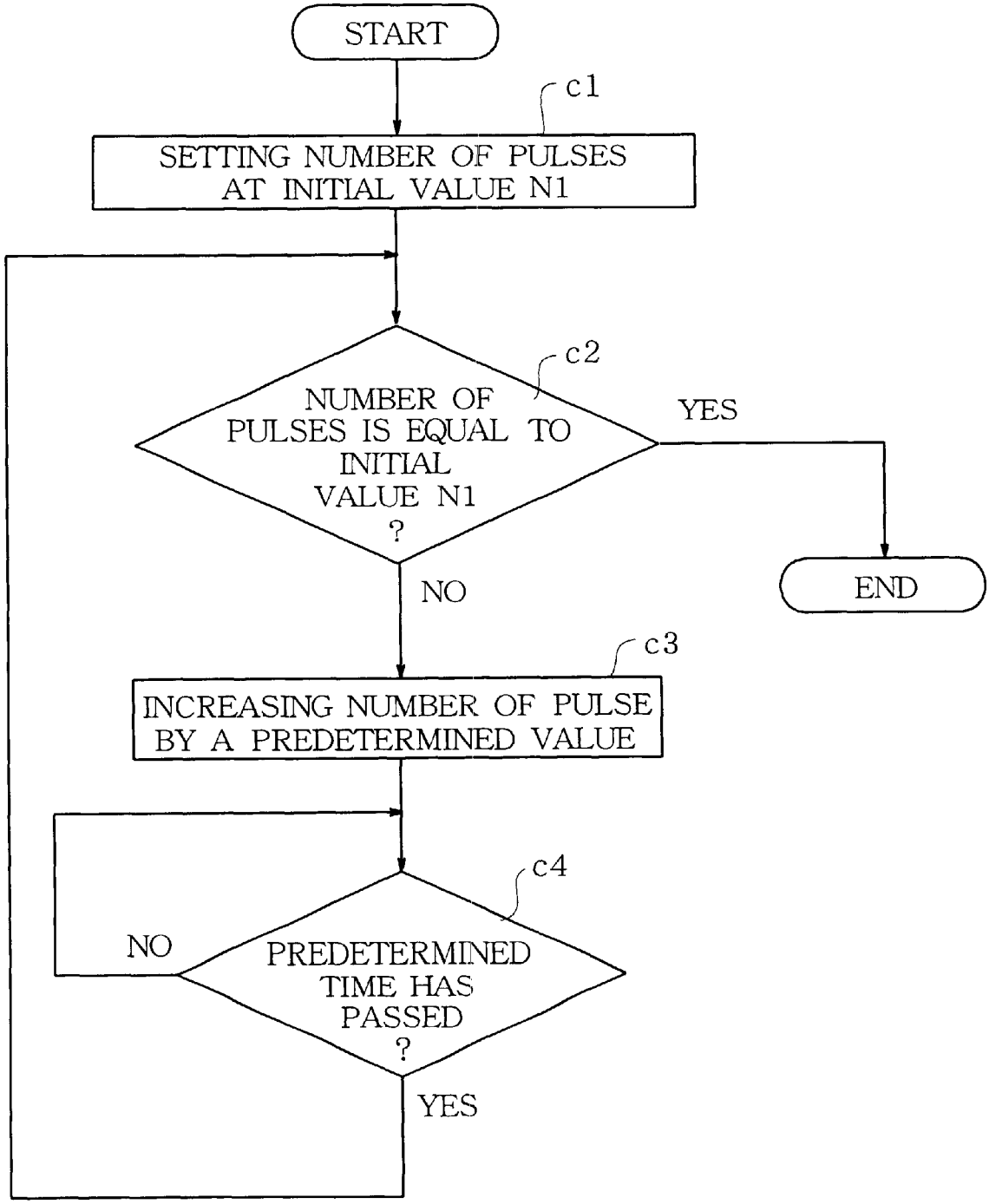
FIG. 5 is a flowchart indicating a procedure for increasing the brightness of the plasma display panel.
Figure 6:
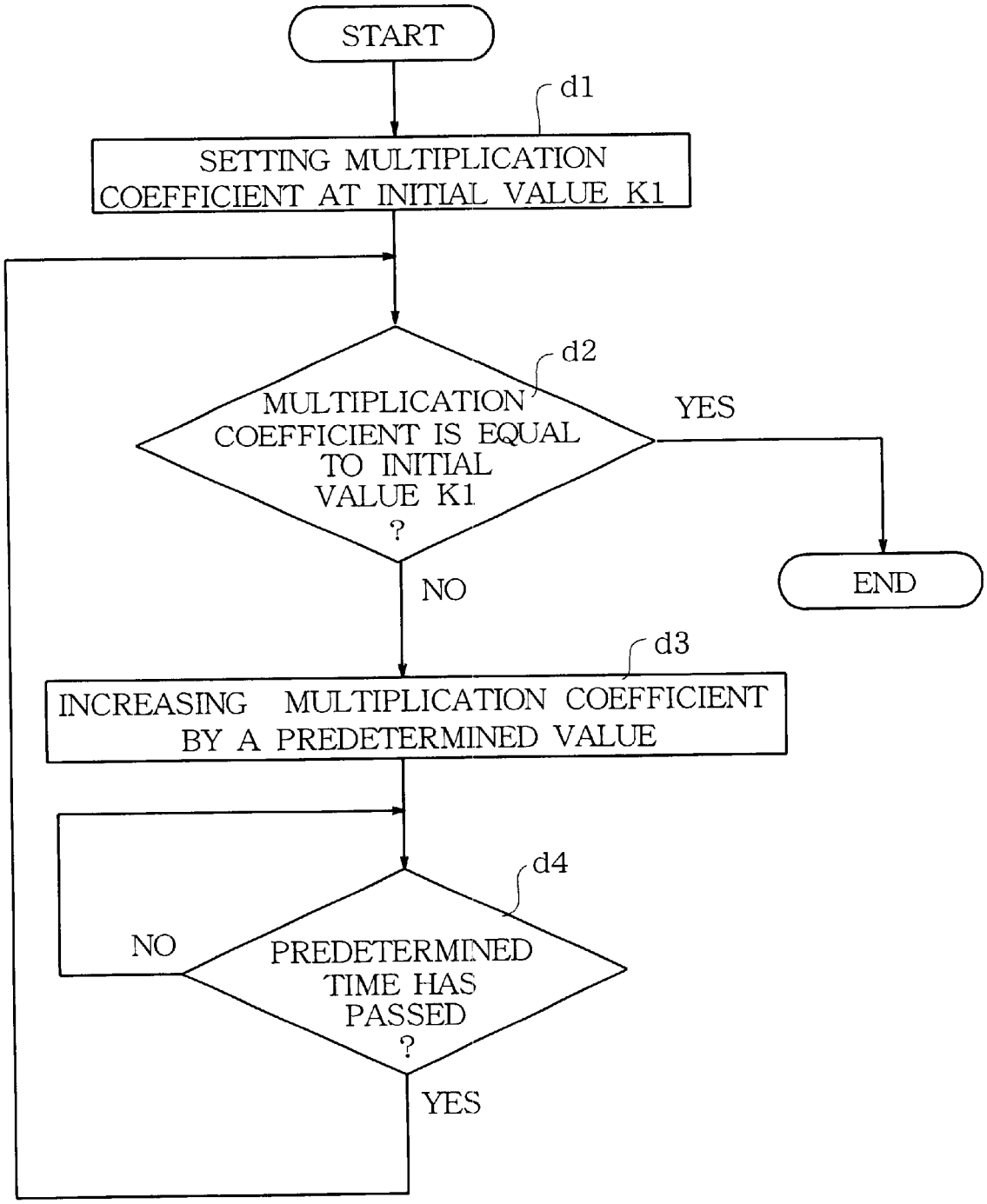
FIG. 6 is a flowchart indicating another procedure for increasing the brightness of the plasma display panel.

In fact, the brightness increasing treatment is just a reversed treatment of the above-described brightness reducing treatment, and there are two kinds of methods for performing the brightness increasing treatment, with one being shown in FIG. 5 and the other in FIG. 6. In detail, the two methods may be mutually changed-over automatically or manually.

Figure 12:
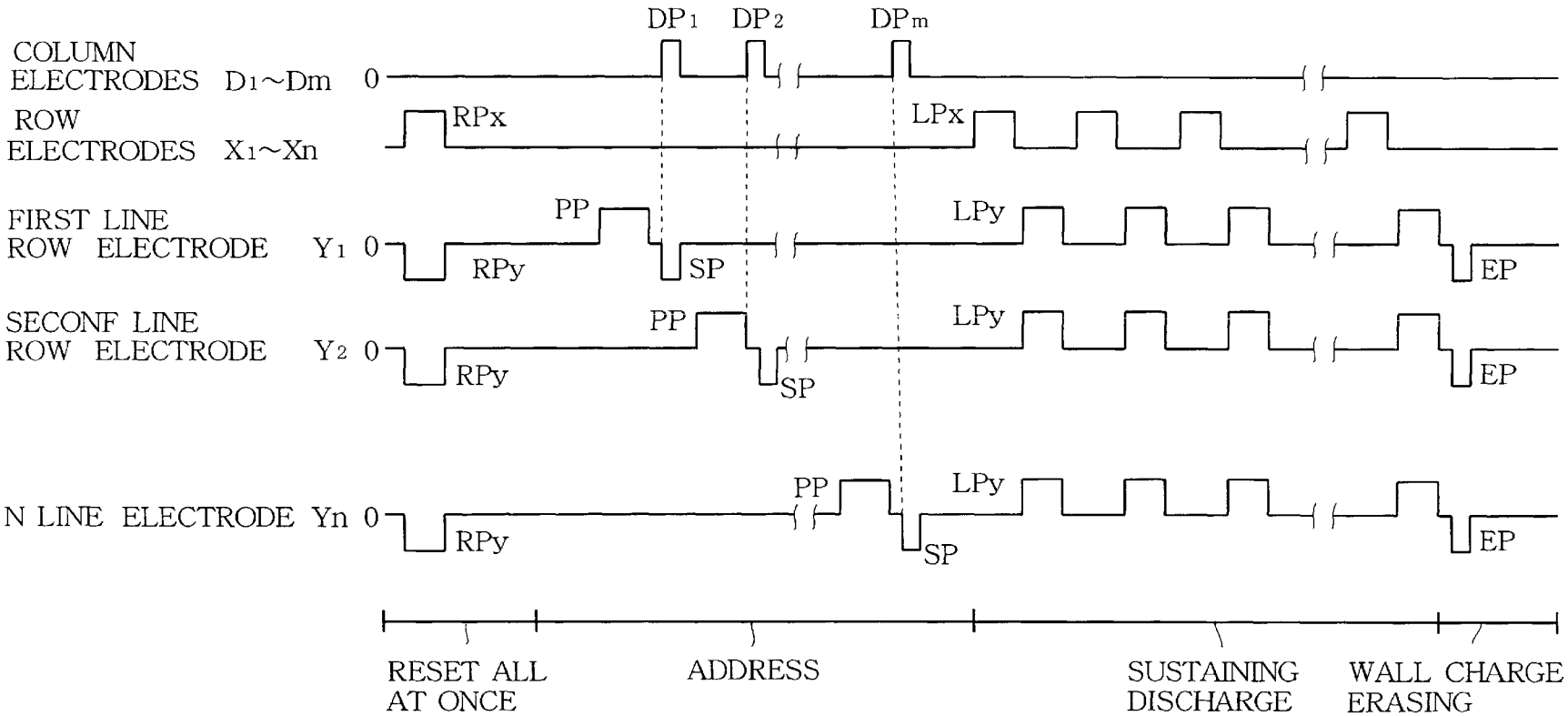
FIG.12 PRIOR ART
FIG. 12 is a timing chart indicating a timing for applying various pulses to the plasma display panel, using a method according to a prior art.
Figure 13:
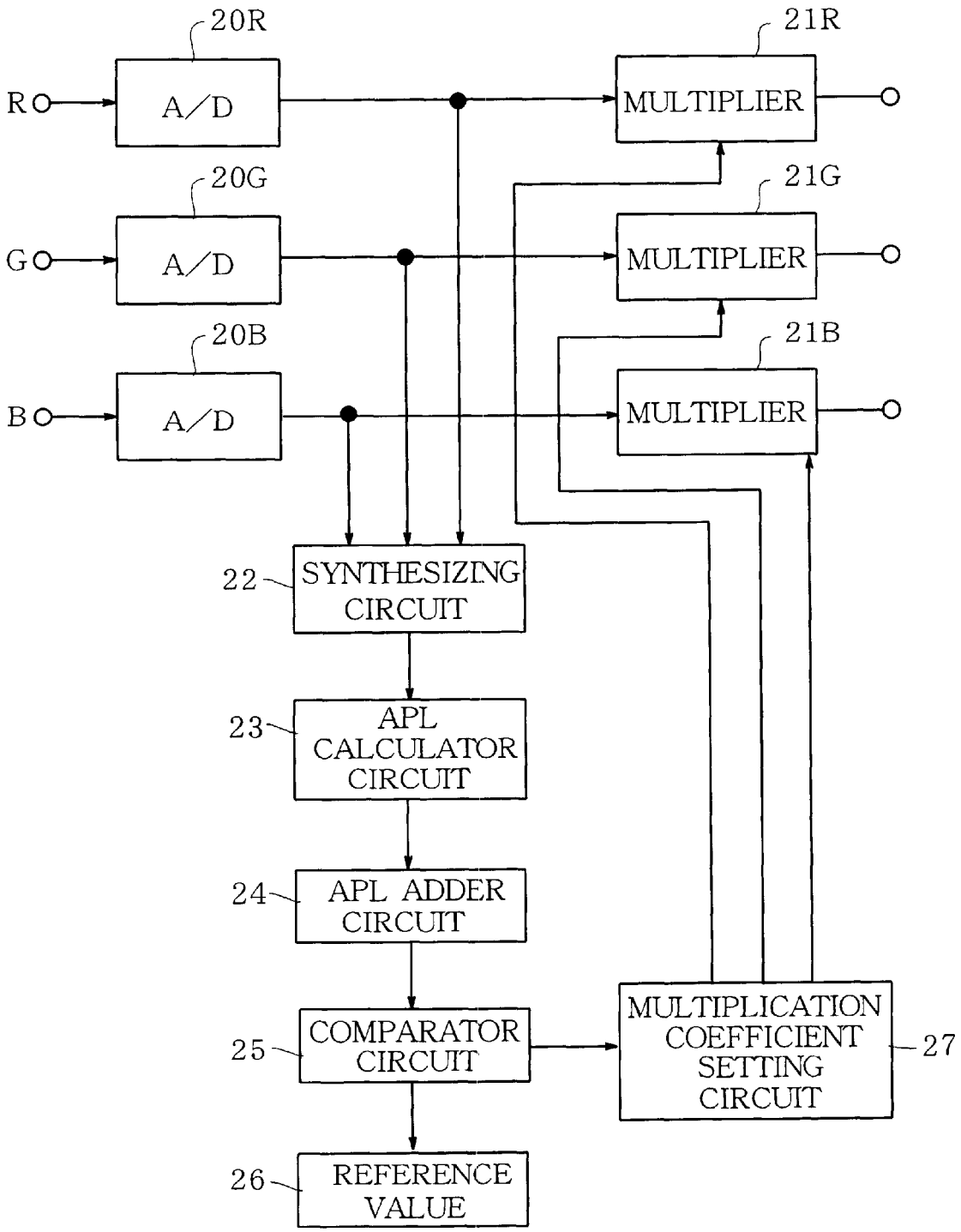
FIG.13 PRIOR ART
FIG. 13 is a block diagram indicating a system for driving a plasma display panel, according to a prior art.
Figure 15:
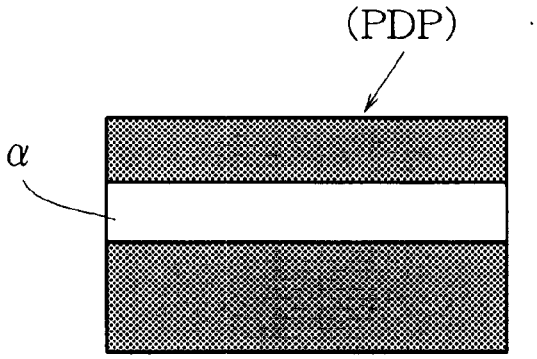
FIG.15 PRIOR ART
FIG. 15 is an explanatory view indicating one example of a picture pattern of a stationary picture.
Figure 16:
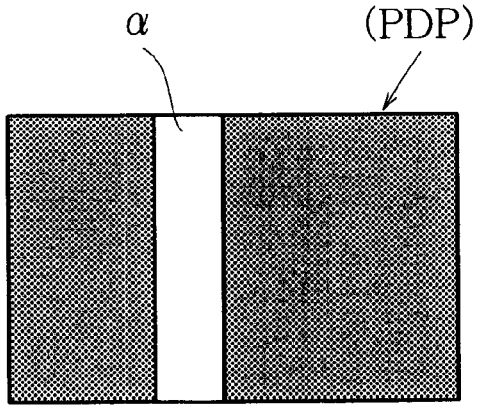
FIG.16 PRIOR ART
FIG. 16 is an explanatory view indicating another example of a picture pattern of a stationary picture.

In a method shown in FIG. 5, the number of sustaining pulses applied from the row electrode driving pulse generating circuit 11 to the row electrodes Xi, Yi (i=1, 2 . . . n) of the PDP 12 is increased so as to increased the number of times for discharge luminescence, thereby increasing the brightness of a picture displayed on the PDP 12 (as shown in FIG. 12).

Namely, once the brightness increasing treatment at step S8 in FIG. 2 is decided to be executed, the number of sustaining pulses is set (step c1 in FIG. 5) at an initial value N1.

Then, it is determined at step c2 whether the number of the sustaining pulses applied from the row electrode driving pulse generating circuit 11 to the row electrodes Xi, Yi (i=1, 2 . . . n) of the PDP 12 has been set at the initial value N1.

If it is determined at the step c2 that the number of the sustaining pulses has already been set at the initial value N1, it is understood that the brightness increasing treatment is just in its process of being executed. On the other hand, if it is determined at step c2 that the number of the sustaining pulses has not been set at the initial value N1, the row electrode driving pulse generating circuit 11 is controlled (at step c3) to increase the number of sustaining pulses being applied to PDP 12 by a predetermined number, in accordance with a reading-out timing signal applied to the row electrode driving pulse generating circuit 11.

Then, it is determined at a step c4 whether a predetermined time for increasing the number of sustaining pulses has passed. If it is determined that said predetermined time has passed, the program returns to the step c2 so as to repeat the process beginning with step c2.

However, when the program is at the step c3, it is required that the number of sustaining pulses should not increased all at once. Further, an operation (to determine whether a predetermined time for reducing the number of sustaining pulses has passed) performed at at step c4 is useful in obtaining an effect that the increasing of the number of the sustaining pulses will be gradual, thereby preventing a sudden brightening of a picture displayed on the PDP 12.

Subsequently, the steps c2–c4 are repeated so that the number of sustaining pulses fed from the row electrode driving pulse generating circuit 11 is increased gradually. At this moment, if it is determined at the step c2 that the number of the sustaining pulses has been increased to the initial value N1, the increasing process is stopped, so that the number of the sustaining pulses are maintained at the initial value N1.

In a method shown in FIG. 6 which employs a gradual stop of ABL (Automatic Brightness limiter), the multiplication coefficients to be multiplied with digital color signals R, G, B are made larger.

Namely, once the brightness increasing treatment at step S8 in FIG. 2 is decided to be executed, the multiplication coefficients to be multiplied with the digital color signals R, G, B in the multipliers 32R, 32G, 32B are each set (step d1 in FIG. 6) to be equal to an initial value K1.

Then, it is determined at a step d2 whether the multiplication coefficients set in the multipliers 32R, 32G, 32B are each equal to an initial value K1.

If it is determined at the step d2 that the multiplication coefficients set in the multipliers 32R, 32G, 32B are each equal to an initial value K1, it is understood that the brightness increasing treatment is just in its process of being executed. On the other hand, if it is determined at step d2 that the multiplication coefficients set in the multipliers 32R, 32G, 32B are not equal to the initial value K1, the multiplication coefficients to be multiplied with digital color signals R, G, B in the multipliers 32R, 32G, 32B are each increased by a predetermined value (step d3).

Then, it is determined at a step d4 whether a predetermined time for increasing the multiplication coefficients has passed. If it is determined that said predetermined time has passed, the program returns to the step d2 so as to repeat the process beginning with step d2.

However, when the program is at the step d3, it is required that the multiplication coefficients to be multiplied with digital color signals R, G, B in the multipliers 32R, 32G, 32B should not be increased to be equal to the initial value K1 all at once. Further, an operation (to determine whether a predetermined time for increasing the multiplication coefficients has passed) performed at at step b4 is useful in obtaining an effect of preventing a sudden brightening of a picture displayed on the PDP 12 by avoiding a sudden increasing of the brightness.

Subsequently, the steps d2–d4 are repeated so that the the multiplication coefficients to be multiplied with digital color signals R, G, B in the multipliers 32R, 32G, 32B are increased gradually. At this moment, if it is determined at the step d2 that each of the multiplication coefficients has already become equal to the initial value K1, the increasing process is stopped, so that the multiplication coefficients are each maintained at the initial value K1.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A method of controlling a brightness of a picture displayed on a plasma display panel by increasing or decreasing said brightness, said method comprising:

determining whether a video signal to be fed to the plasma display panel is a signal indicating a stationary picture; and reducing the brightness of a picture displayed on the plasma display panel if it is determined that a video signal to be fed to the plasma display panel is a signal indicating a stationary picture, wherein when it is determined that a video signal to be fed to the plasma display panel is a signal indicating a stationary picture, multiplication coefficients are made smaller which will be multiplied with video signals to be fed to the plasma display panel to adjust the brightness of the stationary picture displayed on the plasma display panel.

2. The method according to claim 1, wherein one average brightness level of a video signal to be fed to the plasma display panel is detected during a predetermined period, said one average brightness level is then compared with a former average brightness level detected immediately before the detection of said one average brightness level, so as to obtain a difference between said one average brightness level and said former average brightness level.

3. The method according to claim 2, wherein when the difference between said one average brightness level and said former average brightness level is smaller than a predetermined value and such condition has continued for a predetermined time, it is deduced that said video signal is a signal indicating a stationary picture.

4. The method according to claim 1, wherein when it is determined that a video signal to be fed to the plasma display panel is a signal indicating a stationary picture, the number of sustaining pulses for maintaining luminescent discharge on the plasma display panel is reduced.

5. The method according to claim 4, wherein the number of sustaining pulses for maintaining luminescent disharge on the plasma display panel is reduced gradually step by step.

6. A system for controlling a brightness of a picture displayed on a plasma display panel by increasing or decreasing said brightness, said system comprising:

determining means for determining whether a video signal to be fed to the plasma display panel is a signal indicating a stationary picture; and brightness reducing means for reducing the brightness of a picture displayed on the plasma display panel if it is determined that a video signal to be fed to the plasma display panel is a signal indicating a stationary picture, wherein the brightness reducing means is capable of reducing multiplication coefficients to be multiplied by video signals to be fed to the plasma display panel so as to adjust the brightness level of the video signals.

7. The system according to claim 6, wherein the determining means comprises:

average brightness level detecting means for detecting during a predetermined period one average brightness level of a video signal to be fed to the plasma display panel;

calculating means for comparing said one average brightness level with a former average brightness level detected immediately before the detection of said one average brightness level and for obtaining a difference between said one average brightness level and said former average brightness level;

monitor means for monitoring whether the difference obtained by the calculating means has continuously been smaller than a predetermined value for a predetermined time;

wherein when the monitor means determines that the difference obtained by the calculating means has continuously been smaller than a predetermined value for a predetermined time, it is deduced that said video signal is a signal indicating a stationary picture.

8. The system according to claim 6, wherein the brightness reducing means is capable of reducing the number of sustaining pulses for maintaining luminescent discharge on the plasma display panel.

9. The system according to claim 8, wherein the brightness reducing means is capable of reducing the number of the sustaining pulses gradually step by step.

10. A method of controlling a brightness of a picture displayed on a plasma display panel by increasing or decreasing said brightness, wherein one average brightness level of a video signal to be fed to the plasma display panel is detected during a predetermined period, said one average brightness level is then compared with a formed average brightness level detected immediately before the detection of said one average brightness level, so as to obtain a difference between said one average brightness level and said former average brightness level, wherein the display brightness is reduced when an average difference between said one average brightness level and said former average brightness level is within a predetermined range.

11. A system for controlling a brightness of a picture displayed on a plasma display panel by increasing or decreasing said brightness, said system comprising:

average brightness level detecting means for detecting during a predetermined period one average brightness level of a video signal to be fed to the plasma display panel;

calculating means for comparing said one average brightness level with a former average brightness level detected immediately before the detection of said one average brightness level and for obtaining a difference between said one average brightness level and said former average brightness level; and monitor means for monitoring whether the difference obtained by the calculating means has continuously been smaller than a predetermined value for a predetermined time;

wherein the display brightness is reduced when the monitor means determines that an average difference obtained by the calculating means has continuously been within a predetermined range.

* * * * *